US006669382B2

(12) United States Patent
Takenoshita et al.

(10) Patent No.: US 6,669,382 B2
(45) Date of Patent: Dec. 30, 2003

(54) PRINTER AND METHOD OF CONTROLLING THE SAME

(75) Inventors: Hiroyuki Takenoshita, Sagamihara (JP); Tsutomu Sawa, Fujisawa (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/063,106

(22) Filed: Mar. 21, 2002

(65) Prior Publication Data

US 2002/0136577 A1 Sep. 26, 2002

(30) Foreign Application Priority Data

Mar. 23, 2001 (JP) ..... 2001-086094

(51) Int. Cl.[7] ..... B41J 11/20; B41J 2/30

(52) U.S. Cl. ..... 400/56; 400/55; 400/57; 400/58; 400/124.3

(58) Field of Search ..... 400/55, 56, 57, 400/58, 355, 124.3; 347/8, 19; 101/93.05

(56) References Cited

U.S. PATENT DOCUMENTS

| | | | | | |
|---|---|---|---|---|---|
| 4,657,415 | A | * | 4/1987 | Kikuchi et al. | 400/59 |
| 4,990,004 | A | * | 2/1991 | Kawahara et al. | 400/56 |
| 5,051,008 | A | * | 9/1991 | Honda et al. | 400/59 |
| 5,074,685 | A | * | 12/1991 | Shimizu et al. | 400/56 |
| 5,137,377 | A | * | 8/1992 | Ito et al. | 400/56 |
| 5,156,464 | A | * | 10/1992 | Sakai | 400/56 |
| 5,156,465 | A | * | 10/1992 | Kakiuchi | 400/56 |
| 5,156,466 | A | * | 10/1992 | Inagaki et al. | 400/56 |
| 5,257,867 | A | * | 11/1993 | Ito et al. | 400/56 |
| 5,316,395 | A | * | 5/1994 | Imai | 400/56 |
| 5,468,076 | A | * | 11/1995 | Hirano et al. | 400/59 |
| 5,474,391 | A | * | 12/1995 | Andou et al. | 400/55 |
| 5,474,392 | A | * | 12/1995 | Matsuoka | 400/56 |
| 5,499,876 | A | * | 3/1996 | Hosokawa et al. | 400/56 |
| 5,518,324 | A | * | 5/1996 | Campbell et al. | 400/56 |
| 5,529,405 | A | * | 6/1996 | Breitenbach et al. | 400/56 |
| 5,570,959 | A | * | 11/1996 | Moriwaki et al. | 400/56 |
| 5,704,721 | A | * | 1/1998 | Ikehata et al. | 400/55 |
| 5,816,724 | A | * | 10/1998 | Hada et al. | 400/656 |
| 6,171,001 | B1 | * | 1/2001 | Nonaka | 400/58 |
| 6,315,468 | B2 | * | 11/2001 | Kishida et al. | 400/55 |
| 6,386,770 | B1 | * | 5/2002 | Nagai et al. | 400/56 |
| 6,431,771 | B2 | * | 8/2002 | Nagai et al. | 400/56 |

FOREIGN PATENT DOCUMENTS

| | | | | |
|---|---|---|---|---|
| JP | 9090867 | * | 4/1996 | B41J/25/308 |

OTHER PUBLICATIONS

IBM Technical Disclosure Bulletin, Carrier Stop Mechanism, vol. 39—No. 08 Aug. 1996.*

IBM Technical Disclosure Bulletin, Forms Compensation for Point–of–sale printers vol. 34—No. 4A Sep. 1991.*

IBM Technical Disclosure Bulletin, Platen Mechanism for Passbook/Citform Printer, vol. 38—No. 11 Nov. 1995.*

* cited by examiner

*Primary Examiner*—Andrew H. Hirshfeld
*Assistant Examiner*—Wasseem H. Hamdan
(74) *Attorney, Agent, or Firm*—Ido Tuchman; Derek Jennings

(57) ABSTRACT

A printer including a printing head for performing printing while moving over a printing medium, a gap roller capable of rolling along a direction of moving of the printing head, and a platen bar placed so as to face the printing head and the gap roller. The printer further includes a controller for controlling a pressing force of the platen bar applied to the gap roller according to a printing end position of the printing head on the printing medium.

22 Claims, 17 Drawing Sheets

[Figure 1]
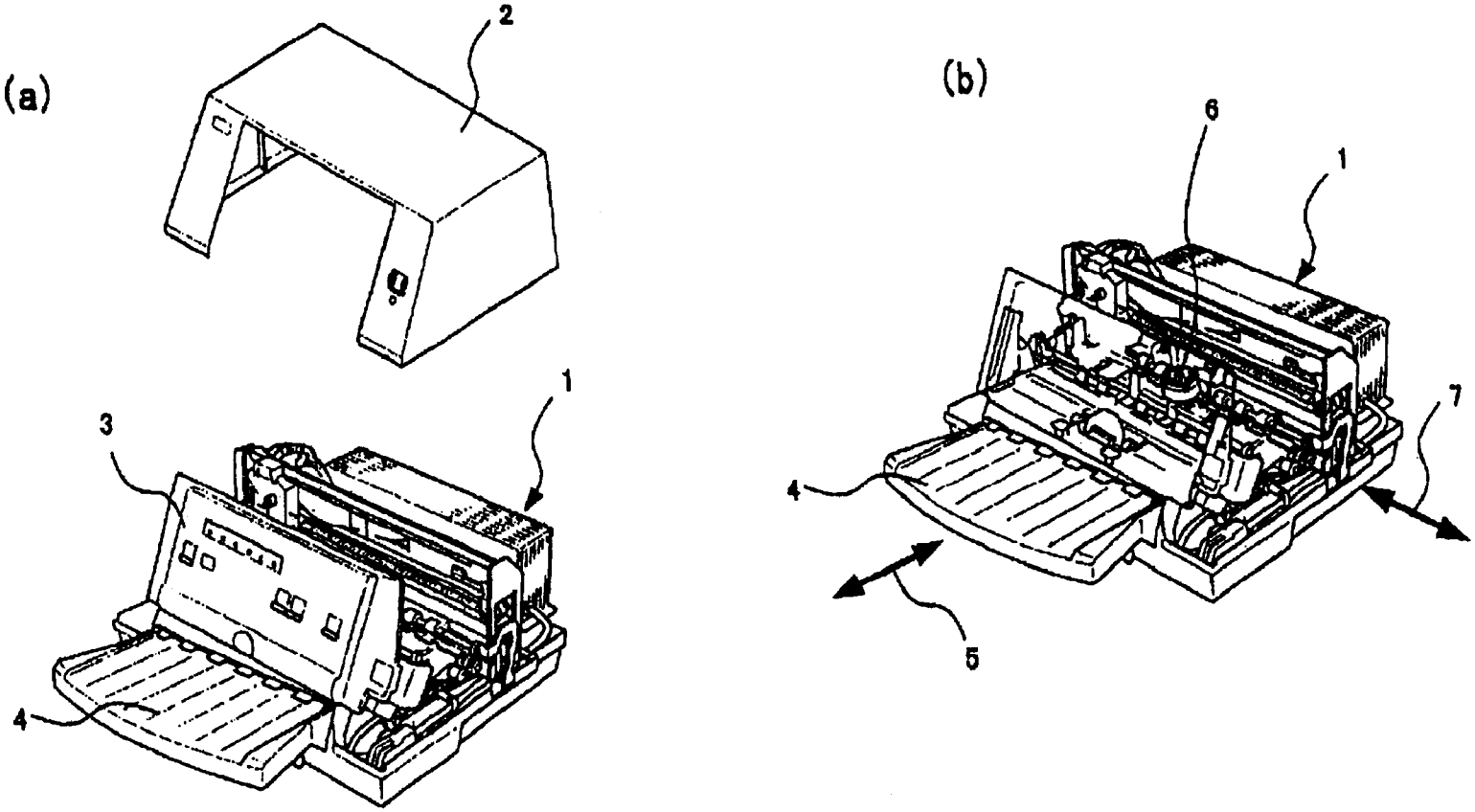

[Figure 2]
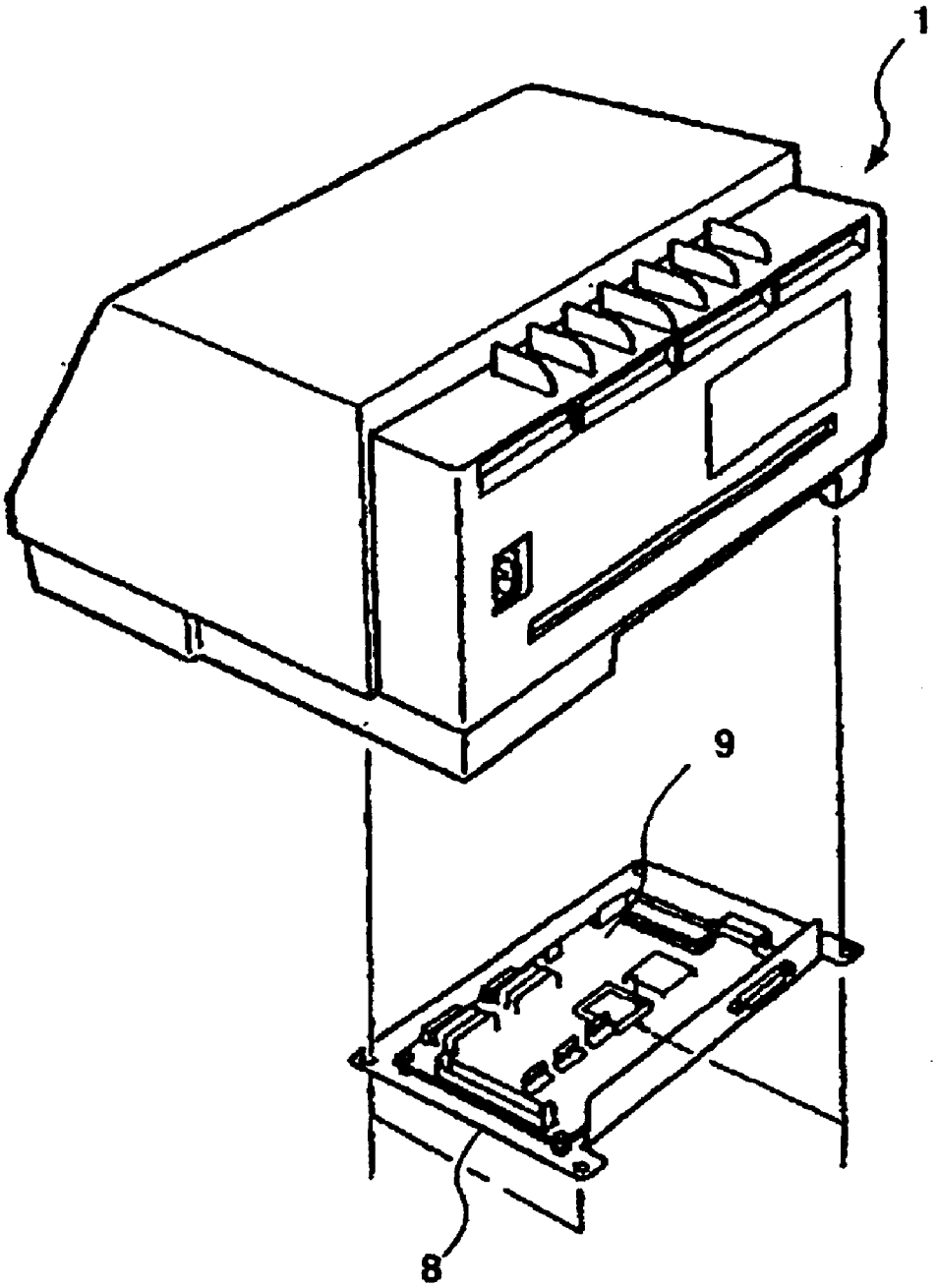

[Figure 3]
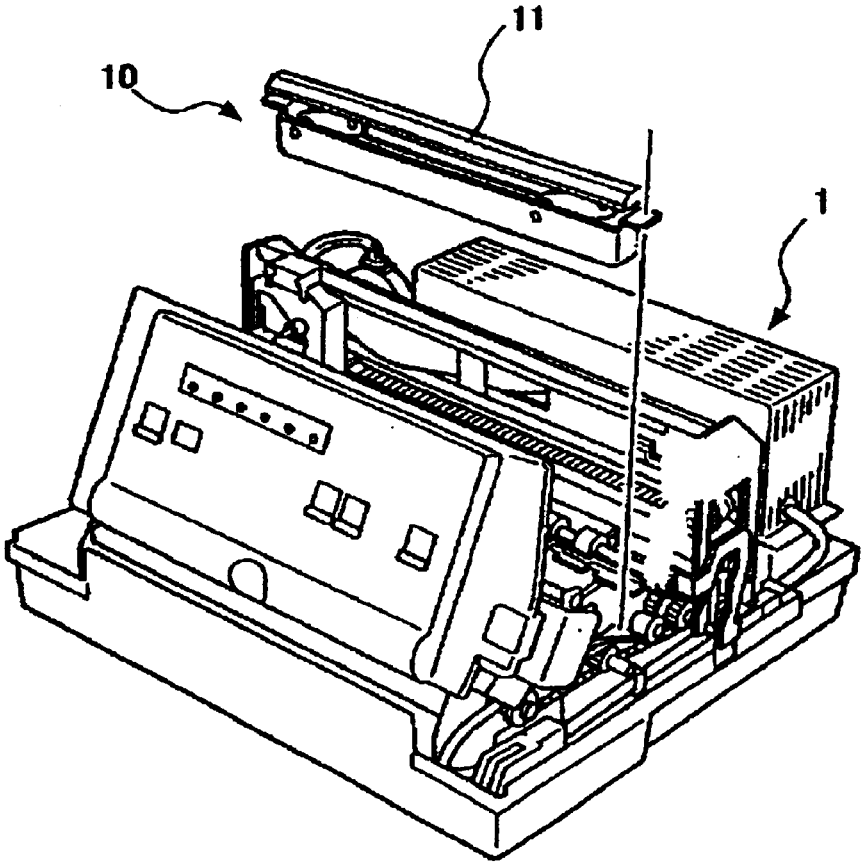

[Figure 4]
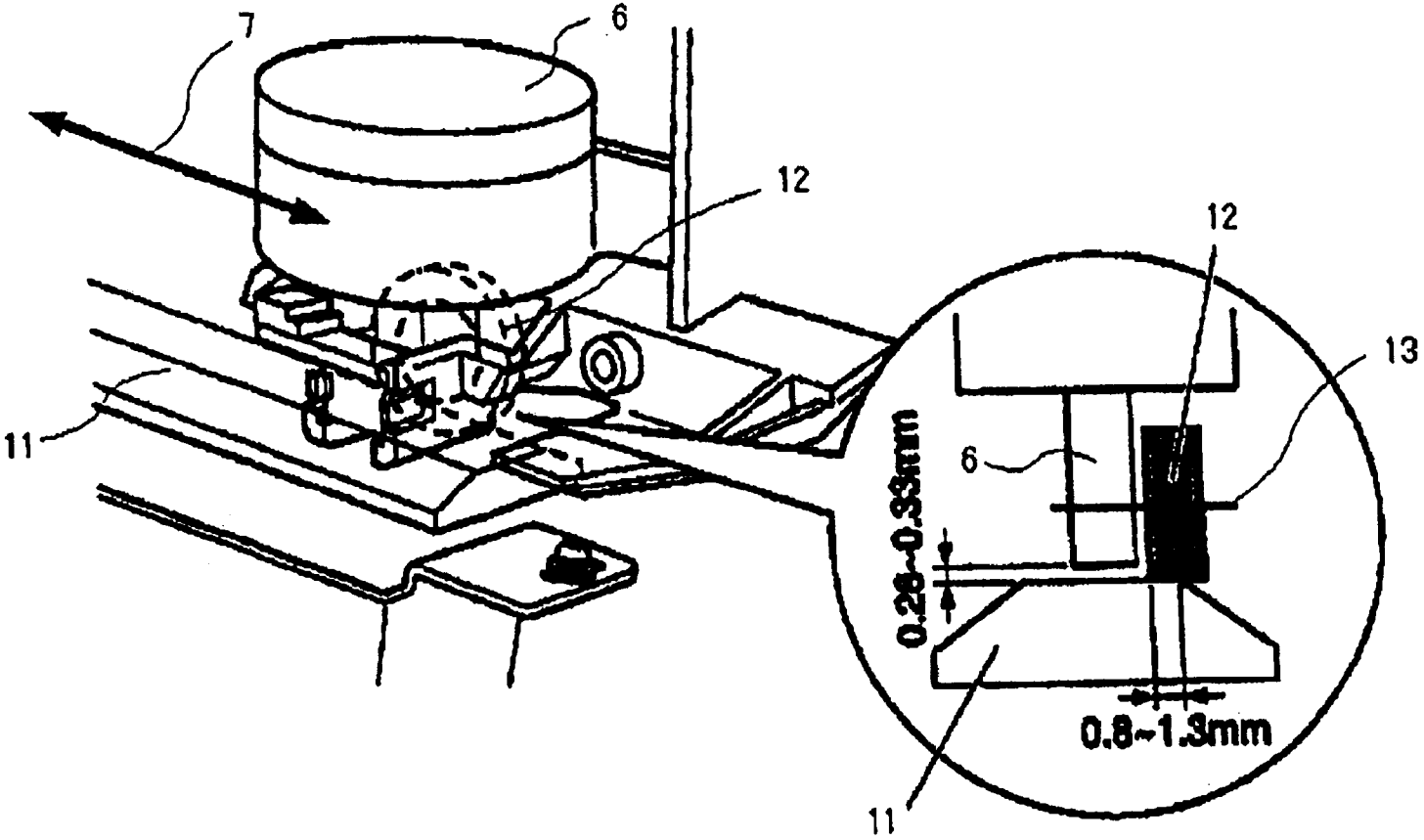

[Figure 5]
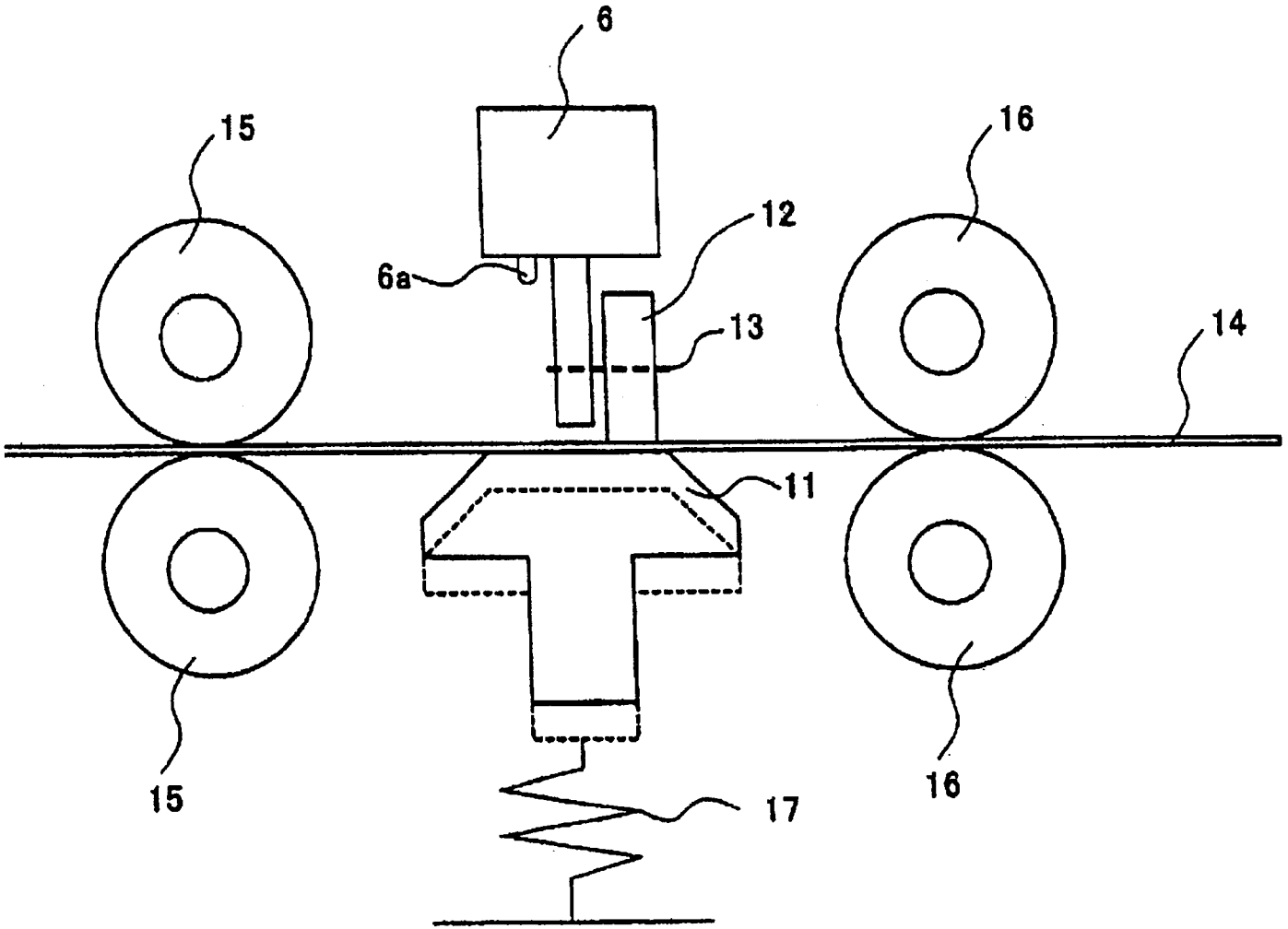

[Figure 6]
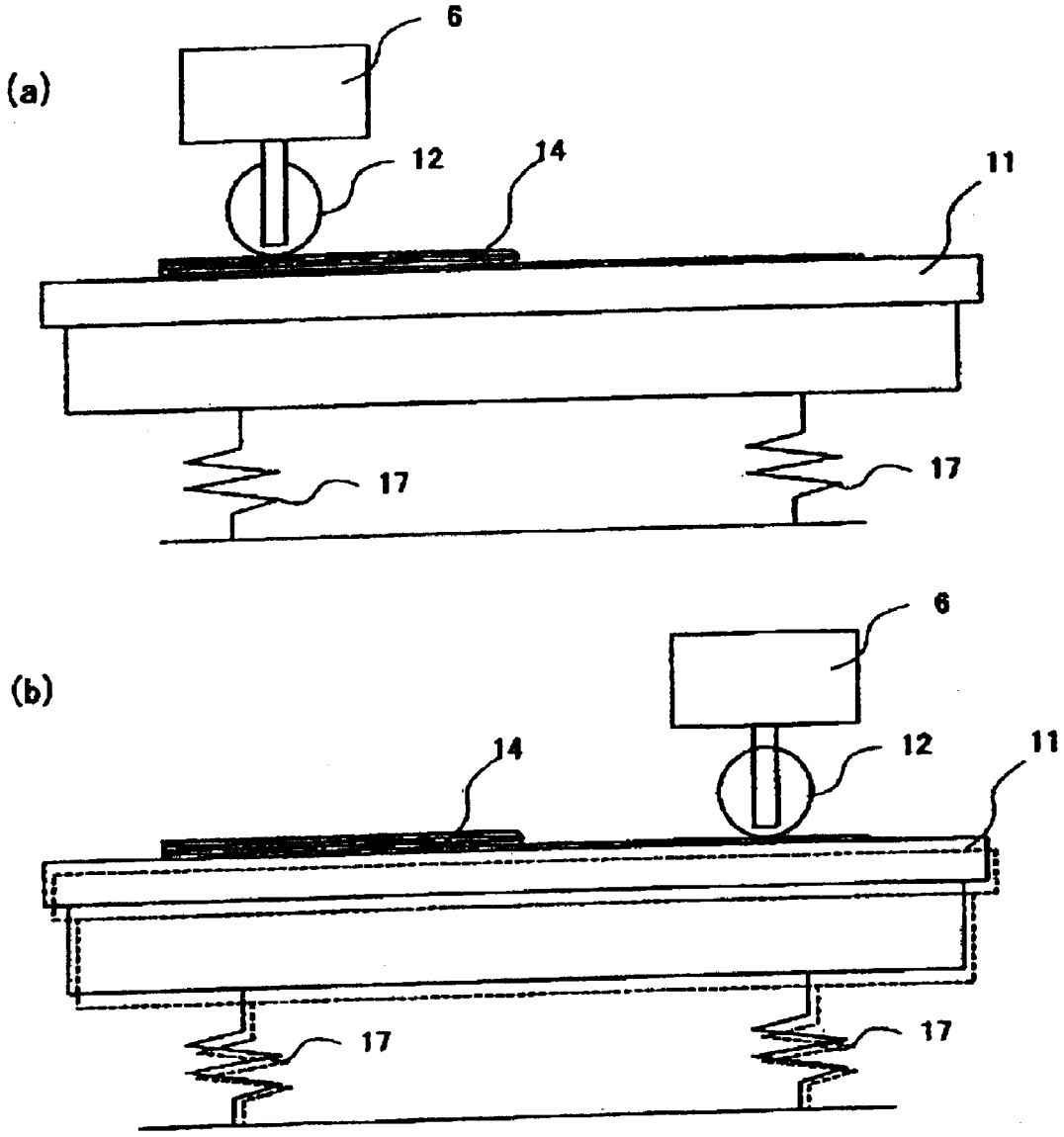

[Figure 7]
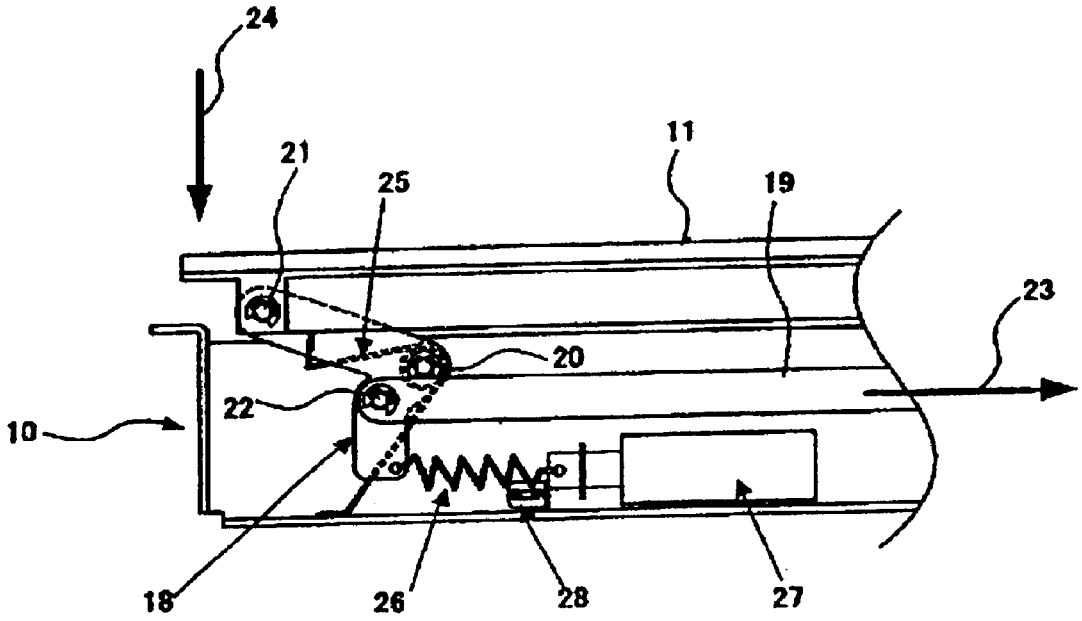

[Figure 8]
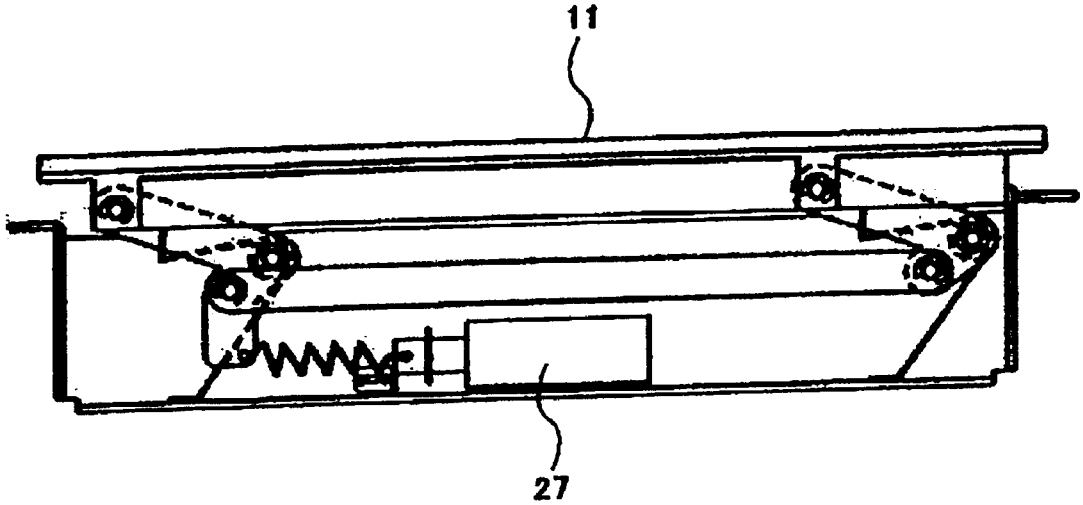

[Figure 9]
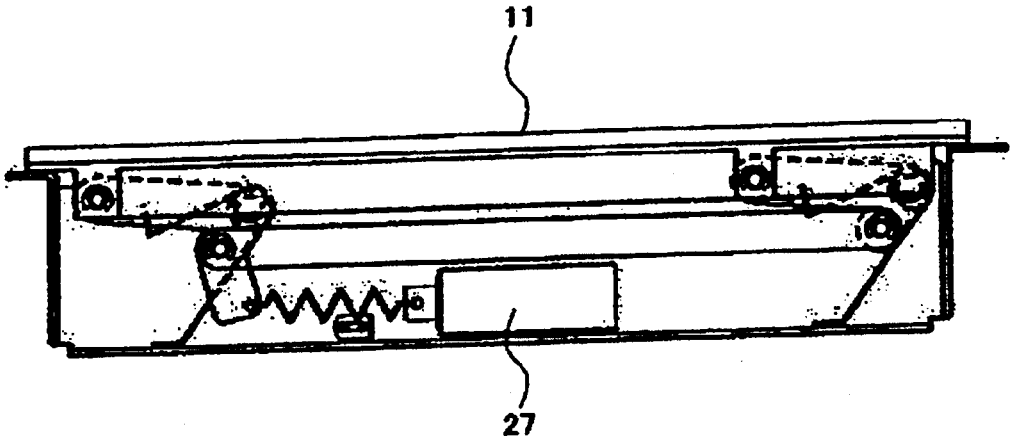

[Figure 10]
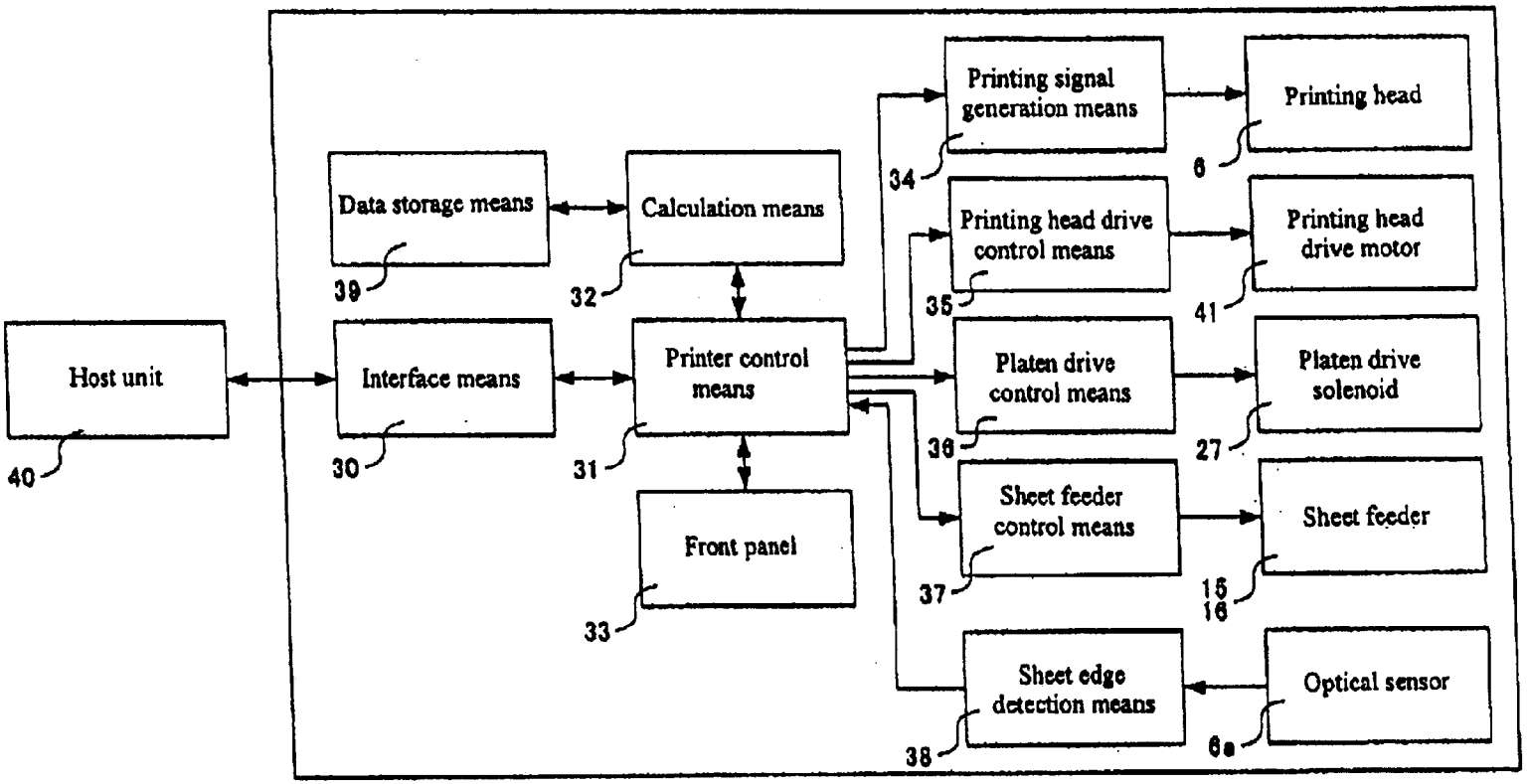

[Figure 11]
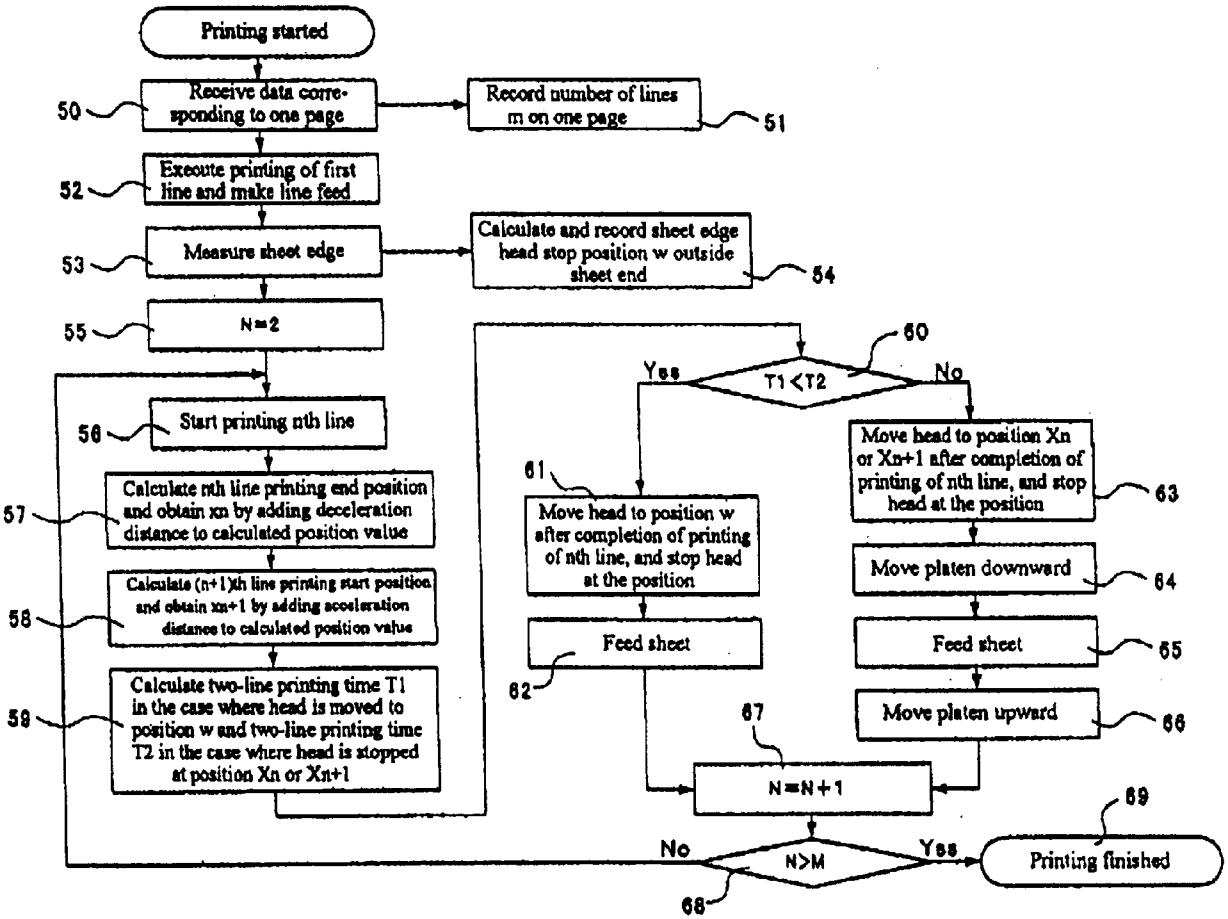

[Figure 12]
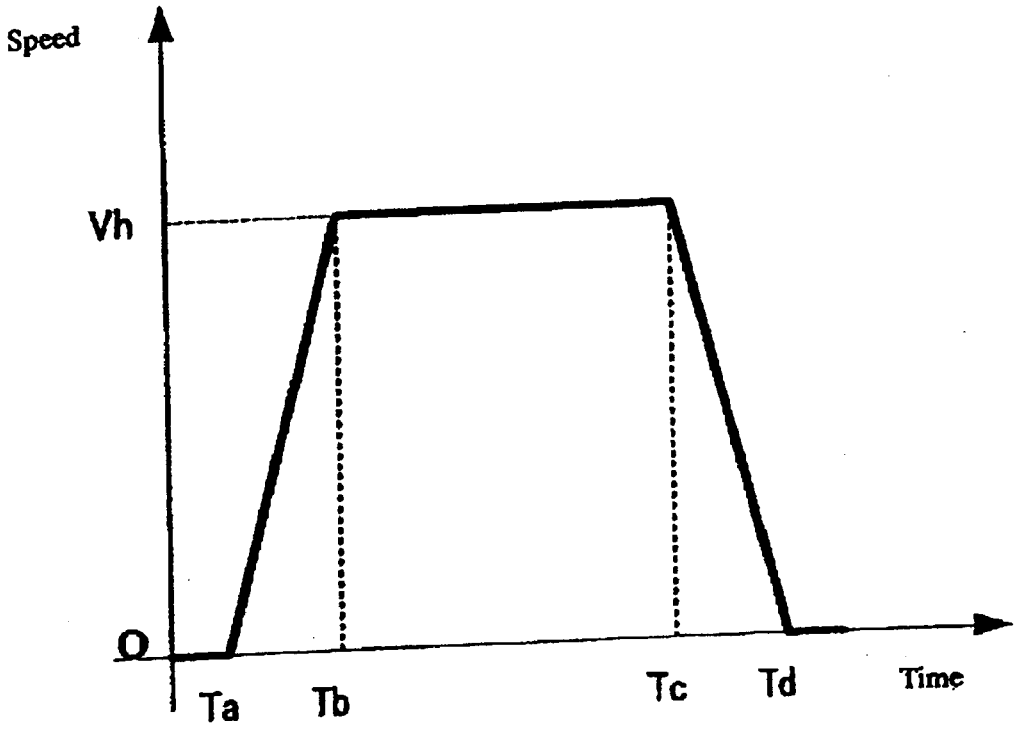

[Figure 13]
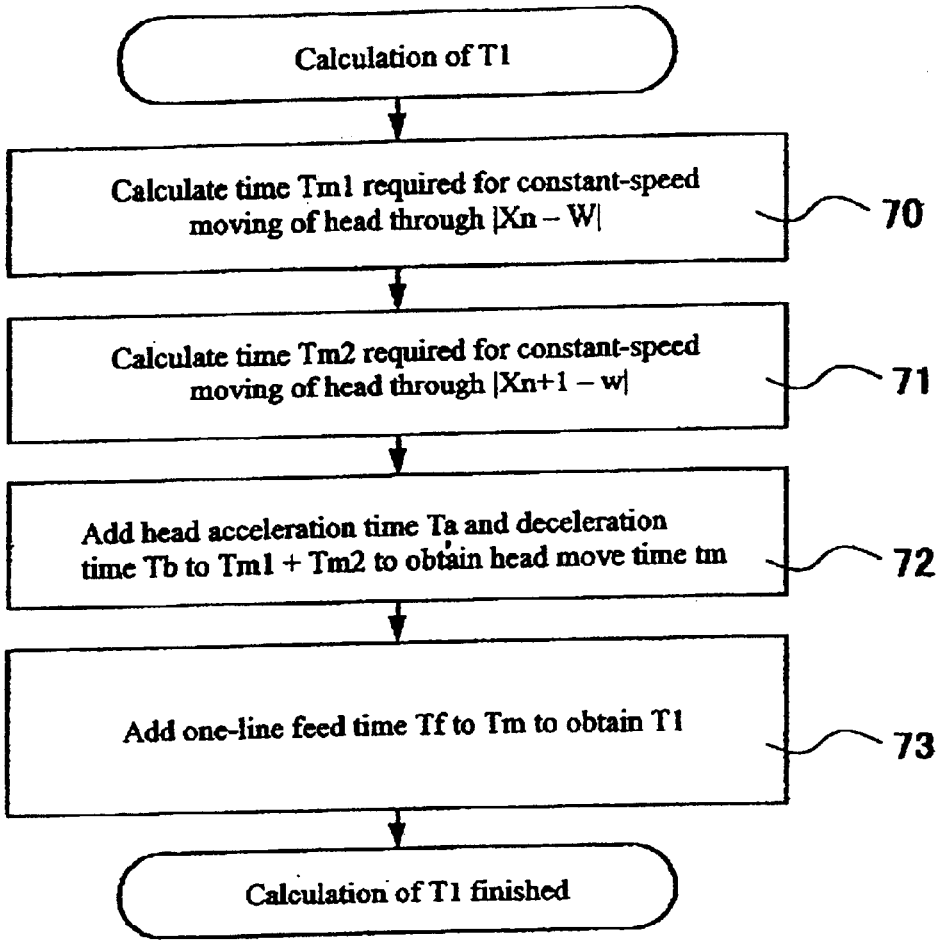

[Figure 14]
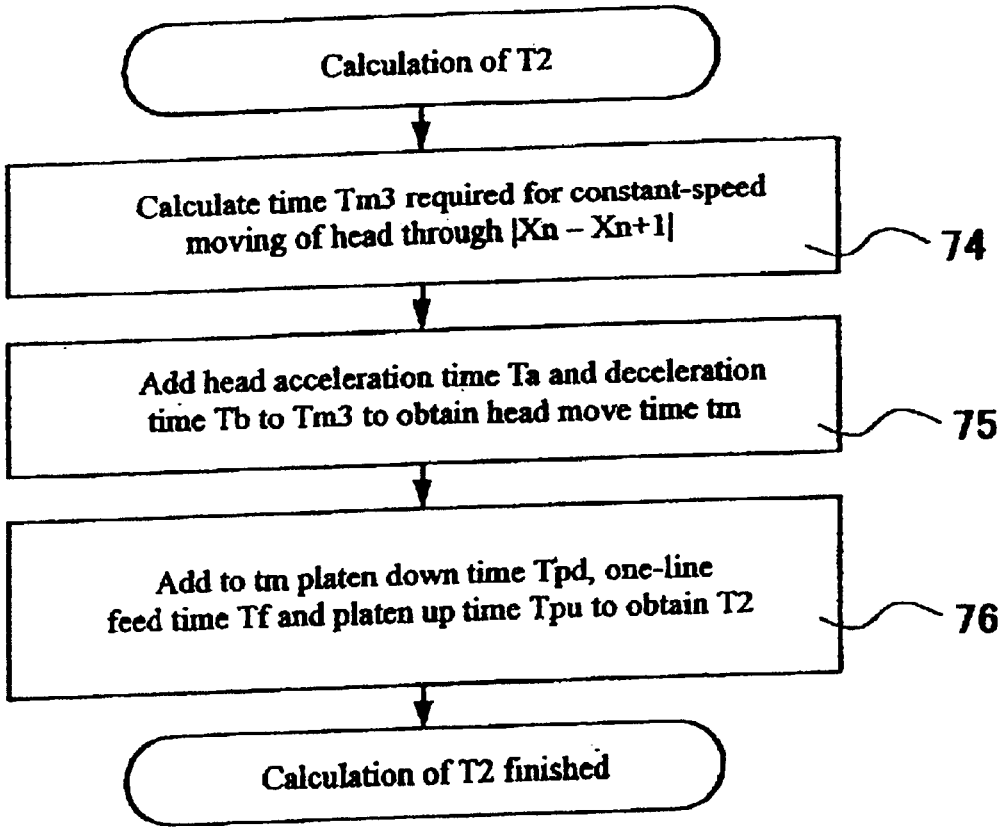

[Figure 15]
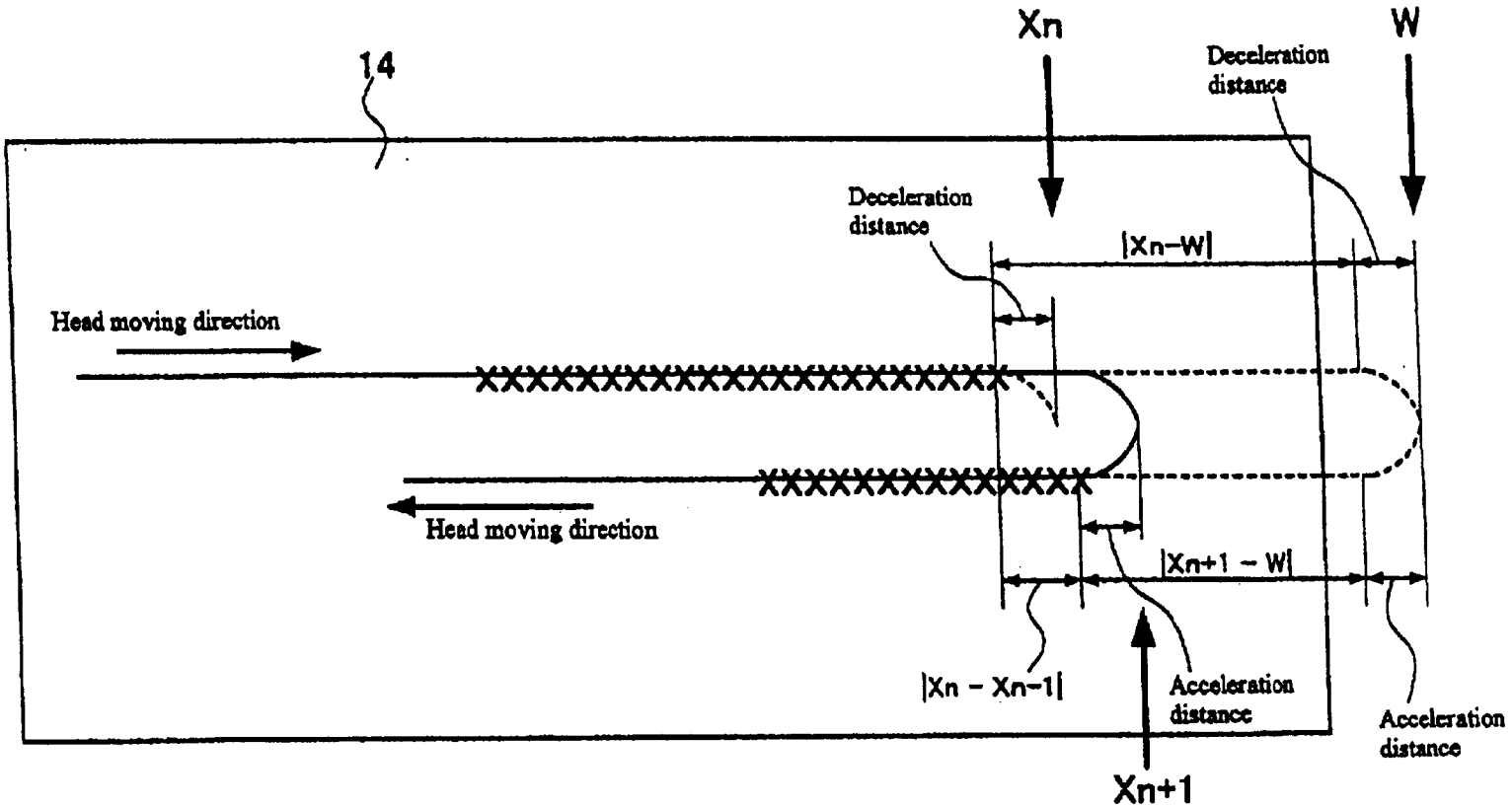

[Figure 16]
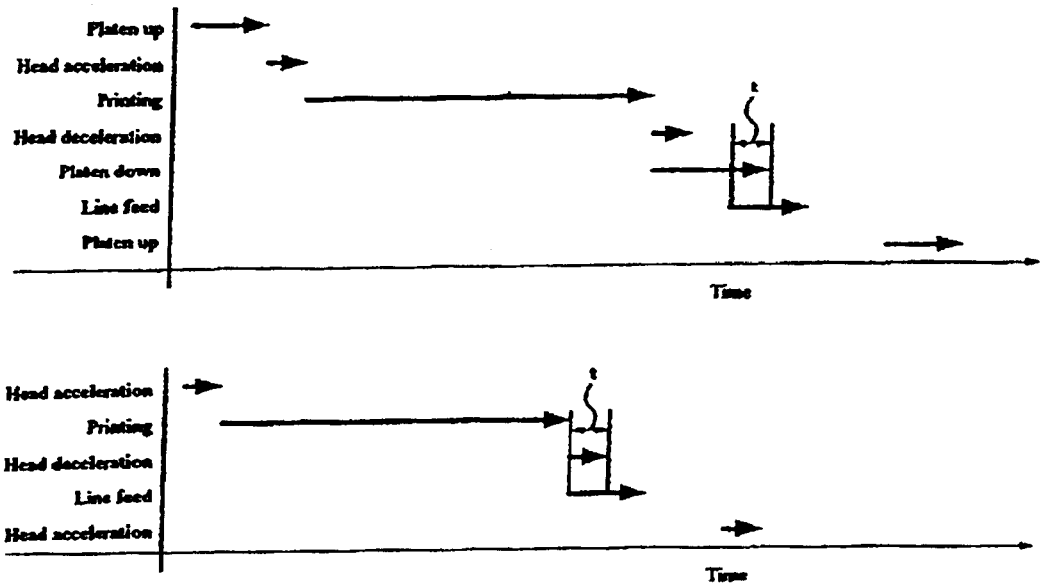

[Figure 17]
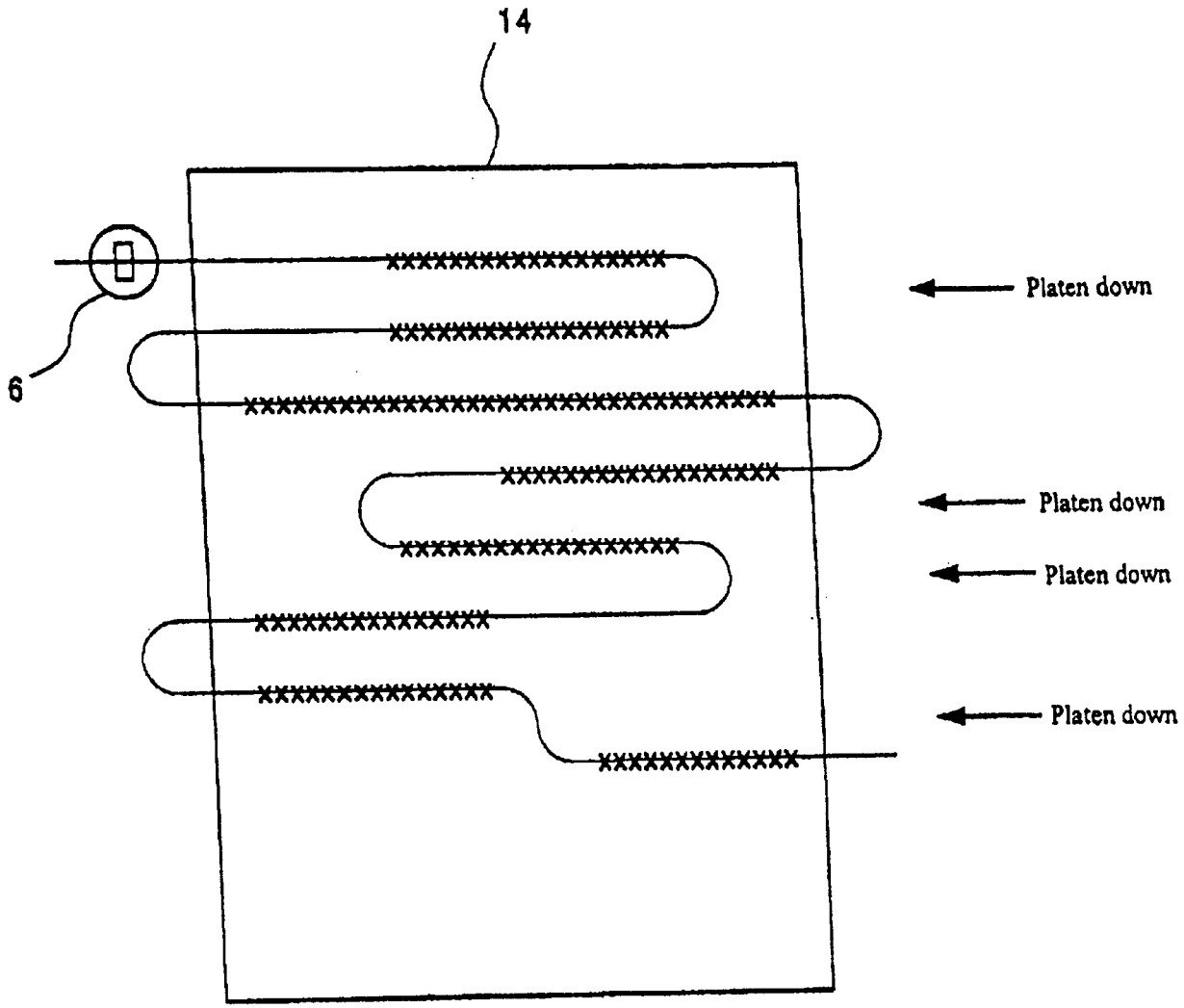

PRINTER AND METHOD OF CONTROLLING THE SAME

BACKGROUND OF INVENTION

1. Field of the Invention

The present invention relates to a printer and a method of controlling the printer and, more particularly, to a technique effective in improving the printing speed of a printer for printing on pages of a passbook used in a service offered by a financial institution, a bunch of slips formed of sheets of carbon paper or pressure-sensitive paper, etc.

2. Background Art

A printer used as a computer system output device has a printing head with which characters or images are printed on a printing medium such as paper, a mechanism (feed mechanism) for feeding the printing medium, and a control circuit for controlling the printing head and the feed mechanism. The printing head moves in a direction perpendicular to the direction in which the printing medium is fed. With the printing head thus moving, one line of characters or a portion of an image corresponding to one line is printed. After printing of one line, line feed of the printing medium is performed by the feed mechanism, the steps of printing one line and performing line feed are repeated to perform printing on one page.

If the printing medium is limited to ordinary printing paper, a printer can be constructed basically in the above-described manner since the allowable paper thickness can be restricted. However, if a printing medium not uniform in thickness and having a large maximum thickness is used, it is necessary to devise means for constantly maintaining the distance (gap) between the head and the printing medium even when the medium thickness changes. That is, in the case of printing on a bankbook used as a printing medium, it is impossible to constantly maintain the gap between the printing head and the printing medium by simply feeding the printing medium with the feed mechanism while maintaining the printing medium in a state of facing the printing head. Also, in the case of printing on a printing medium not uniform in thickness along the direction of moving of the printing head, e.g., a passport or a bankbook in a country other than Japan, on which characters are printed laterally, and which is opened along a left-right direction, or on a printing medium having a fold, a mechanism is required which constantly maintains the gap by continually moving the printing head or the platen so that the gap is constant while the printing head is moving in the printing direction.

If the gap varies or an air layer exists due to a fold as described above, a reduction in printing quality results. The following are two typical methods conventionally used to cope with this problem. In the first method, an abutment bar having an opening in correspondence with a printing area is disposed between the platen mechanism and the printing head, and a printing medium is inserted between the abutment bar and the platen and is pressed against the abutment bar by the platen mechanism during printing with the head. In this case, the printing surface of the printing medium is maintained flush with the lower surface of the abutment bar since the surface of the printing medium is pressed against the abutment bar by the platen mechanism. The printing position of the head is selected in advance in correspondence with the lower surface of the abutment bar. Thus, the desired head gap is maintained to ensure good printing quality.

In the second method, a roller capable of rolling along the direction of moving of the head is disposed and a printing medium is inserted between the roller and the platen mechanism. The platen mechanism is arranged so as to always apply a force for pressing against the roller. The roller thereby presses the printing medium to constantly maintain the gap by removing an air layer even if the printing medium has a fold or variation in thickness, thus obtaining good printing quality.

The first method described above, however, requires making the printing medium movable by releasing the pressing force of the platen bar before the feed mechanism starts operating to effect line feed of the printing medium. That is, at the time of line feed of the printing medium, it is necessary to perform the steps of releasing pressing by the platen bar and thereafter making the platen bar press the printing medium. The time for the line feed operation is increased if these steps are performed, resulting in an increase in total printing time.

In the case of the second method, line feed of the printing medium cannot be performed when the printing medium is interposed between the head roller and the platen mechanism. That is, if line feed is performed while the printing medium is pressed against the head roller by the platen mechanism, the printing medium is creased or, if the printing medium is carbon paper or the like, a trailing mark is left in a portion pressed against the roller. Creases in the printing medium may cause transfer failure or a reduction in printing quality. Therefore it is necessary that line feed of the printing medium be performed when the head roller is at the end of the platen bar out of the region where it faces the printing medium. If feeding is performed under this condition, it is necessary to move the head to the end of the platen bar even in a situation where the amount of printing of one line is small, that is, the amount of space in one line is large. This means that the time period required for moving of the printing head includes a time period during which printing with the head is not actually performed.

The printing time of the printer is a user's waiting time. Needless to say, it is desirable to increase operating speed of the printer by considering user' convenience.

An object of the present invention is to provide a printer capable of maintaining high printing quality and a high printing speed even if the printing medium has variation in thickness or has a fold, and a method of controlling the printer so that the printer has such improved performance.

SUMMARY OF INVENTION

The present invention will be outlined below. That is, a printer in accordance with the present invention includes a printing head for performing printing while moving over a printing medium, a gap roller capable of rolling along the direction of moving of the printing head, a platen bar placed so as to face the printing head and the gap roller, and a controller for controlling the pressing force of the platen bar applied to the gap roller according to a printing end position of the printing head on the printing medium.

The present invention may be understood as a method for controlling a printer in the above-described manner.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWING

FIGS. 1*a* and 1*b* are diagrams showing an entire of a printer 1 which represents an embodiment of the present invention.

FIG. 2 is a diagram showing the printer 1 and a bottom cover 8 removed from the printer 1.

FIG. 3 is a diagram showing the printer 1 and a platen mechanism 10 removed from the printer 1.

FIG. 4 is an enlarged diagram of a portion of a printing head 6.

FIG. 5 is a side view schematically showing a state where a printing medium 14 is inserted between a printing head and a platen bar 11.

FIGS. 6*a* and 6*b* are front views schematically showing a state where the printing medium 14 is inserted between the printing head and a platen bar 11.

FIG. 7 is a diagram showing an example of the platen mechanism in the embodiment of the present invention.

FIG. 8 is a diagram showing a state where a solenoid 27 is not energized and the platen bar 11 is in an upper position.

FIG. 9 is a diagram showing a state where the solenoid 27 is energized and the platen bar 11 is in a lower position.

FIG. 10 is a block diagram schematically showing an example of the functions of the printer in the embodiment of the present invention.

FIG. 11 is a flowchart showing an example of a printing control method in the embodiment of the present invention.

FIG. 12 is a graph schematically showing states of moving of the head.

FIG. 13 is a flowchart showing an example of calculation of time T1.

FIG. 14 is a flowchart showing an example of calculation of time T2.

FIG. 15 is a diagram showing head locus with respect to times T1 and T2.

FIG. 16 is a time chart showing an example of the two kinds of processing with respect to times T1 and T2.

FIG. 17 is a diagram showing an example of the head locus in the case where the control method of the embodiment of the present invention is used.

DETAILED DESCRIPTION

The printer in accordance with the present invention further comprises a feeding unit for moving the printing medium between the printing head and the platen bar. The controller releases the pressing force if, after the completion of printing of the currently printed line, the printing head is stopped at a position on the printing medium which is one of the printing end position with respect to the currently printed line and a print start position with respect to printing of the next line, and restores the pressing force after the feed means has fed the printing medium. The controller does not release the pressing force if, after the completion of the printing of the currently printed line, the printing head is stopped at a position outside the region where the printing medium exists. The printer further comprises a unit for calculating a first time period required for printing of the currently printed line and the next line to be printed in the case where the pressing force is released, the feeding unit feeds the printing medium, and the pressing force is then restored, and a second time period required for printing of the currently printed line and the next line to be printed in the case where the pressing force is not released, and a unit for making a determination as to whether the first time period is shorter than the second time period. The controller executes control corresponding to the shorter of the first and second time periods.

In the printer arranged as described above, the shorter of two time periods: the printing time in the case where the pressing force is released, the feed means feeds the printing medium, and the pressing force is then restored; and the printing time in the case where the pressing force is not released is determined at the time of printing of each line, thereby making it possible to reduce the time required for printing processing of the entire page. Either kind of printing control ensures high printing quality since the pressing force is applied from the platen mechanism when printing is performed on the printing medium. When the feeding operation is performed to effect a line feed of the printing medium, the pressing force from the platen mechanism is released or the head roller is positioned out of the region where the printing medium exists, thus preventing occurrence of creases and coloring in carbon paper caused by the feeding operation.

The unit for calculating the first and second time periods includes means for obtaining a presupposed print end position with respect to the currently printed line, and means for obtaining a presupposed print start position with respect to the next line to be printed, and the first time period (T1) can be calculated on the basis of an equation: $T1=(|Xa-Xb|/Vh)+\max(Tb, Td)+Tf-t+Tu+Ta$, and the second time period (T2) is calculated on the basis of an equation: $T2=(|Xa-Xw|/Vh)+(|Xb-Xw|/Vh)+\max(Tb, Tf)+Ta$. In these equations, where Xa is the presupposed printing end position; Xb is the presupposed printing start position; Xw is the position outside the region where the printing medium exists; Vh is the moving speed of the printing head; Tb is the time between a start of deceleration of the printing head and the completion of stopping of the printing head; Td is the time period required for the controller to release the pressing force; Tf is the time period required for the feeding unit to feed the printing medium to the position corresponding to the next line to be printed; t is a possible time overlap between Td and Tf; Tu is the time period required for the controller to restore the pressing force; Ta is the time period between a start of acceleration of the printing head and a time at which the printable speed is reached; and max(a, b) is a function for selecting the larger of a and b.

The above-described controller may include a plurality of levers each having one end pinned upon a lower portion of the platen bar and rotatable about an axis of rotation perpendicular to a direction in which the platen bar is moved, and a single parallel link extending parallel to the platen bar and pinned upon the other end of each of the lever. When the parallel link moves in a direction corresponding to the direction of rotation of each lever, the platen bar is translated in a direction perpendicular to the direction of movement of the parallel link. In the controller arranged, the plurality of levers rotate through the same angle in cooperation with one link, thereby increasing the parallelism of the parallel link including the platen bar while the platen bar is moved (upward or downward). The parallelism of the platen bar with respect to the printing head is thereby improved to ensure high printing quality. The controller may also include a first spring for rotating the lever in a first direction such as to move the platen bar upward, and a driving for applying a force to the other end of the lever or to the parallel link to make the lever rotate in a second direction opposite to the first direction. These elements enable the platen bar to be normally pressed against the head roller, but act to release the pressing force when the drive means is energized. An elastic member (e.g., a coil spring) may also be provided between the other end of the lever or the parallel link and the drive means to buffer the drive impact.

The above-described printing head may be selected from a wire dot printing head, a bubble jet printing head, an ink jet printing head, a thermal transfer type of printing head, and a thermal sublimation type of printing head. The printing head may have a sensor for detecting edges of the printing medium. The printing medium may be of such a type as to have variation in thickness along the direction of reciprocal moving of the printing head.

An embodiment of the present invention will be described in detail with reference to the accompanying drawings. However, the present invention can be implemented in various forms and the contents of the embodiment described below are not to be construed to limit the invention. Throughout the description of the embodiment, the same components are indicated by the same reference numerals.

FIGS. 1A and 1B illustrate the entire of a printer 1 which represents an embodiment of the present invention. FIG. 1A shows the printer 1 and a top cover 2 removed from the printer 1. FIG. 1B is a diagram schematically showing internal mechanisms as if they are seen through a front panel 3. A printing medium, e.g., a sheet of paper is transported (fed) by a sheet feed mechanism along directions indicated by arrows 5 in a state of being put on a tray 4. The printing medium is assumed to have a generally rectangular shape. If the printing medium is in an oblique position when transported, the sheet feed mechanism detects it and ejects the printing medium. The sheet feed mechanism or related means includes a sensor for detecting such an obliquely transported state. Details of these components will not be described in this specification.

A printing head 6 is provided in the printer 1. The printing head 6 can move reciprocally along directions indicated by arrows 7. The printing head 6 prints one line on the printing medium in one pass. The printing head 6 is, for example, a wire dot head. However, the printing head 6 is not limited to the wire dot type, and it may alternatively be, for example, a bubble jet printing head, an ink jet printing head, a thermal transfer type of printing head, or a thermal sublimation type of printing head.

FIG. 2 is a diagram showing the printer 1 and a bottom cover 8 removed from the printer 1. A control circuit 9 is provided on the bottom cover 8. The control circuit 9 has semiconductor devices having a computation function and a data storage function and constituting an electronic circuit. The control circuit 9 have the functions of controlling the sheet feed mechanism, a printing head moving mechanism, the printing head, a platen mechanism, etc., as described below in detail.

FIG. 3 is a diagram showing the printer 1 and the platen mechanism, indicated by 10, removed from the printer 1. The platen mechanism 10 is placed below the printing head 6. The platen mechanism 10 has a platen bar 11 capable of moving upward and downward, as described below. The platen bar 11 has a length longer than the range through which the printing head 6 moves. The platen bar 11 is made of, for example, a resin or hard rubber. If the platen bar 11 is made of a resin or hard rubber having certain elasticity, the printing quality in the case of constructing the printing head as a wire dot type in particular can be improved.

FIG. 4 is an enlarged diagram of a portion of the printing head 6. The circular area in FIG. 4 shows a side view of the printing head 6 for explanation of the positional relationship between the platen bar 11 and the printing head 6. The printing head 6 is provided with a head gap roller 12 capable of rolling along the direction of moving of the printing head 6 (indicated by arrows 7). A shaft 13 on which the head gap roller 12 rotates is fixed on the printing head 6, so that the gap of the printing head 6 is determined by the peripheral surface of the head gap roller 12. In this embodiment, the gap is adjusted to 0.28 to 0.33 mm. Actually, an ink ribbon, not specified in this embodiment, is inserted between a printing medium and the printing head 6

FIG. 5 is a side view schematically showing a state where a printing medium 14 is inserted between the printing head and the platen bar 11, and FIG. 6 is a corresponding front view. In FIG. 5 are also illustrated front feed rollers 15 and back feed rollers 16 in the mechanism for feeding the printing medium 14. As the front feed rollers 15 and the back feed rollers 16 rotate, the printing medium 14 is transported or ejected. The printing head 6 has an optical sensor 6*a* having the functions of sensing the existence of the printing medium 14 and detecting edges of the printing medium 14.

The platen bar 11 is always urged by a spring 17 in an upward direction (toward the head gap roller 12) as long as the pressing force is not released by a drive mechanism described below. The printing medium 14 is thereby maintained in a state of being pressed against the head gap roller 12 to remove creases in the printing medium and an air layer formed along the printing medium, so that the gap between the printing medium 14 and the printing head 6 is adjusted within the above-mentioned range. Also, even if the printing medium 14 is not uniform in thickness along the direction of moving of the printing head 6 as shown in FIGS. 6A and 6B, the gap between the gap between the printing medium 14 and the printing head 6 can be adjusted within the above-mentioned range. FIG. 6A shows a state where the printing head 6 is located on a region of the printing medium 14 where the thickness is large, and FIG. 6B shows a state where the printing head 6 is located on a region of the printing medium 14 where the thickness is small. In the state shown in FIG. 6A, the platen bar 11 is moved downward by the head gap roller 12 through the printing medium 14. In the state shown in FIG. 6B, the platen bar 11 is moved upward. Thus, even if the thickness of the printing medium 14 changes, the height of the platen bar 11 is suitably controlled and the gap between the printing medium 14 and the printing head 6 is always adjusted within the suitable range.

In the above-described arrangement, the reaction force received by the printing head 6 from the platen bar 11 varies depending upon the position of the platen bar 11. The reaction force is minimized at each of the left and right ends of the platen bar and is maximized at a position about the center of the platen bar in the lengthwise direction of the same since it is the resultant of the moments of the springs 17. Therefore, if the printing medium 14 is a bankbook or the like, a problem described below may be encountered. That is, when printing is performed on a number of superposed sheets of the bank book at a position about the center of the platen bar 11, the printing medium 14 is depressed by the head gap roller 12 with the larger reaction force to reduce the distance between the head face and the platen bar 11. Thus, such variation in reaction force is liable to cause a reduction in printing quality. In this embodiment, therefore, the platen mechanism sown in FIG. 7 is used.

FIG. 7 is a diagram showing an example of the platen mechanism in this embodiment. The platen mechanism 10 of this embodiment has a lever 18 and a link bar 19. The lever 18 is swingably supported on a shaft 20. Also, the lever 18 is pinned upon a bottom portion of the platen bar 11 at a point 21 and also pinned upon the link bar 19 at a point 22. That is, when the link bar 19 moves in the direction of arrow 23, the platen bar 11 moves in the direction of arrow 24. A similar lever 18, not shown in FIG. 7, is also provided at the right end of the link as viewed in the figure. In this arrangement, even though the position at which the platen bar 11 receives pressure changes, the desired parallelism of the platen bar 1 is maintained according to the characteristic of the parallel link formed by the link bar 19, so that the platen bar 11 has a constant pressing force regardless of the point of application of the force.

In this embodiment are also provided a spring 25, a spring 26, a solenoid 27 and a stopper 28. The spring 25 is adapted to constantly produce such a force as to rotate the lever 18 in the direction opposite to the direction of arrow 24. The spring 26 is provided to buffer the movement of the solenoid 27. The solenoid 27 is energized to produce a force with which the link bar 19 is moved in the direction of arrow 23. This force is applied to the lever 18 through the spring 26, thereby rotating the lever 18 in the direction corresponding to the direction of arrow 24. That is, when the solenoid 27 is energized, the platen bar 11 is set in a downwardly displaced position. Needless to say, to enable this movement of the solenoid 27 to be transmitted to lever 18, it is necessary to set the elastic modulus of the spring 26 to a value sufficiently larger than that of the spring 25. The stopper 28 is set to determine the upper limit of the platen bar 11.

The platen mechanism 10 arranged as described above is used to maintain the desired parallelism of the platen bar 11 by the lever 18 and the link bar 19 with respect to a downwardly-pressing force applied to the platen bar 11 at one point, regardless of the position of the point of application of the force. Also, the reaction force against the downwardly-pressing force can be obtained by using the spring 25. Further, the platen bar 11 can be set in a downwardly set position by the solenoid 27. FIG. 8 is a diagram showing a state where the solenoid 27 is not energized and the platen bar 11 is in an upper position, and FIG. 9 shows a state where the solenoid 27 is energized and the platen bar 11 is in a lower position. The solenoid has been described as means for moving the platen bar 11 by way of example. However, any other drive mechanism, e.g., a rotary motor may alternatively be used.

FIG. 10 is a block diagram schematically showing an example of the functions of the printer in this embodiment. The printer 1 in this embodiment has interface means 30, a printer control means 31, calculation means 32, front panel 33, printing signal generation means 34, printing head drive control means 35, platen drive control means 36, sheet feeder drive control means 37, sheet edge detection means 38, and data storage means 39.

The interface means 30 performs interfacing with a host unit 40. Various control signals, data, etc., from the host unit 40 are transmitted to the printer control means 31. The printer control means 31 controls the entire of the printer 1. The calculation means 32 performs various kinds of calculation including those described below by way of example. The front panel 33 accepts control signals input by a user directly operating the panel 33. The printing signal generation means 34 generates a printing signal which is transmitted to the printing head 6. For example, the printing signal generation means 34 generates signals for driving wires for forming wire dots. The printing head drive control means 35 generates a signal which is supplied to a drive means 41 such as a motor for driving the printing head 6 in the direction indicated by arrow 7 in FIG. 1. The platen drive control means 36 generates a control signal which is supplied to the above-described solenoid 27, for example. The sheet feeder drive control means 37 generates a control signal which is supplied to, for example, a motor for driving the above-described front feed rollers 15 and the back feed rollers 16. The sheet edge detection means 38 receives, for example a signal from the above-described optical sensor 6*a* to detect a sheet end of a printing medium. The data storage means 39 includes a RAM (random access memory) and a ROM (read only memory). Data from the host unit 40, for example, is stored in the RAM, and a control program for controlling the printer, for example, is stored in the ROM.

FIG. 11 is a flowchart showing an example of a printing control method in this embodiment. Control of printing of one page will be described by way of example.

First, data corresponding to one page is received from the host unit (step 50). The received data can be stored in the above-described data storage means 39. From the received one-page data, the number of lines M on the page is obtained and recorded (step 51). Needless to say, data M obtained at this step and calculation data, etc., described below can be stored in the data storage means 39. While the following is the description of a method of performing control after receiving the entire of printing data on one page, it is, of course, possible to use a method of successively determining control steps on the basis of printing data about at least two preceding lines.

Next, printing of the first line is executed (step 52). In this printing of the first line, the printing head 6 is moved through the entire range through which the printing head 6 is movable, thereby measuring an edge of the printing medium (step 53). Measurement of the edge of the printing medium is performed by the above-described sheet edge detection means 38. A presupposed head stop position W is set outside the detected edge of the printing medium (step 54). At this position W, no printing medium 14 portion exists. When the printing head 6 is at the position W, feeding of the printing medium can be performed without moving the platen bar downward. The head position after printing of the first line and moving of the head for this printing is the position W, at which line feed can be made without moving the platen bar downward (step 52).

Next, N=2 is set (step 55) and printing of the Nth line is started (step 56). For starting printing, the head is moved to a predetermined printing start position and printing is performed by driving the head wires. Ordinarily, the necessary time period between the start and end of this printing is several hundred milliseconds. During this time period, calculations and determinations described below can be made.

Calculations and determinations will be made as described below. First, the printing end position at which printing of the Nth line will be completed is calculated. The printing end position can be calculated by extracting data on the Nth line from the one-page data received in step 50 and by referring to the position of the trailing end of the sequence of characters in the line. A head stop position Xn at which the head is stopped after the completion of printing is then obtained by adding a deceleration distance to the printing stop position (step 57). Ordinarily, possible states of the printing head 6 include an accelerated state between the stopped state and a constant-speed state in which the head can operates for printing, the constant-speed state, and a decelerated state between the constant-speed state and the stopped state. FIG. 12 schematically shows such head states. At time Ta, acceleration is started. The head is accelerated until time Tb. From time Tb to time Tc, the head speed is maintained at a constant speed Vh. During this time period, printing can be performed. At time Tc, printing is stopped and a head stopping operation is started. At time Td, the head is stopped. Even if the head stopping operation is started substantially simultaneously with the time at which printing is terminated, the head moves through some distance, i.e., the above-mentioned deceleration distance, during the deceleration period (Tc to Td).

Next, the position at which printing of the (N+1)th line will be started is calculated. This printing start position can be calculated by extracting data on the (N+1)th line from the one-page data received in step 50 and by referring to the position of the leading end of the sequence of characters in the line. This "leading end" and the above-mentioned "trailing end" denote positions in order of appearance of characters in the direction of moving of the head. The printing start position Xn+1 from the head stop position is then obtained by adding the acceleration distance (step 58).

Next, printing time T1 for printing of the Nth line and the (N+1)th line in the case where the head is moved to the above-described position W and printing time T2 for printing of the Nth line and the (N+1)th line in the case where the head is stopped at the position Xn or Xn+1 are calculated (step 59). The lengths of time T1 and time T2 thereby calculated are compared (step 60).

If time T1 is shorter, the following processing is performed. After printing of the Nth line, the head is moved to the position W without being stopped at the printing end position, and is stopped at the position W (step 61). Thereafter, a line feed (sheet feed) is made without moving the platen downward (that is, the platen bar is maintained in the same position) (step 62).

If time T2 is shorter, the head is stopped at the position Xn by stopping moving of the head immediately after the completion of printing of the Nth line, or is stopped at the position Xn+1 (step 63). The solenoid of the platen mechanism is then energized to move the platen bar downward (step 64) and the line feed operation is performed (step 65). Thereafter, the solenoid of the platen mechanism is deenergized to move the platen bar upward (step 66).

As described above, printing is controlled in such a manner that two time periods for printing are compared, the shorter of the two time periods is determined, and one line feed operation including moving the head beyond the edge of the printing medium and the other line feed operation including the platen bar downward, corresponding to the shorter time period, is performed. It is possible to reduce the printing time by using this control method.

After the completion of step 62 or 66, N=N+1 is set (step 67) and a determination is made as to whether N is larger than M, that is, whether processing of data on the page has been completed (step 68). If N is larger than M, the process is terminated. If N is not larger than M, the process returns to step 56 and the above-described steps are repeated, thus performing processing for printing on one page.

Calculations of time T1 and T2 will be described in detail. FIG. 13 is a flowchart showing an example of the process of calculating time T1, and FIG. 14 a flowchart showing an example of the process of calculating time T2.

To calculate T1, time Tm1 required for moving of the head through |Xn−W| is first calculated (step 70). Next, time Tm2 required for moving of the head through |Xn+1−W| is calculated (step 71). Then, the head acceleration time Ta and head deceleration time Tb are added to Tm1+Tm2 to obtain Tm (step 72). Further, feed time Tf is added to Tm to obtain T1 (step 73). To calculate T2, time Tm3 required for moving of the head through |Xn−Xn+1| is first calculated (step 74). Next, head acceleration time Ta and head deceleration time Tb are added to Tm3 to obtain Tm (step 75). Further, platen down time Tpd, feed time Tf and platen bar up time Tpu are added to Tm to obtain T2 (step 76).

FIG. 15 is a diagram showing the head loci with respect to the above-described times T1 and T2. The locus in the case where the head is moved to the position W is indicated by the broken line, and the locus in the case where the head is stopped at the position Xn+1 is indicated by the solid line. The head move distance (|Xn−W| and |Xn+1−W|) in the blank in the case where the head is moved to the position W, is longer than the head move distance (|Xn−Xn+1|) in the case where the head is stopped at the position Xn+1. Processing corresponding to the shorter of the moving time corresponding to the difference between these distances and the time for moving the platen bar downward and upward is selected.

FIG. 16 is a time chart showing an example of the above-described two kinds of processing. In actuality, the sheet feed or platen bar down operation can be started immediately after a start of deceleration, and sheet feed can be started before the completion of the platen bar down operation. Therefore the total printing time can be reduced by the lengths of time overlaps thereby created.

Thus, time T1 and time T2 can be calculated on the basis of the following equations:

$$T1=(|Xa-Xb|/Vh)+\max(Tb,\ Td)+Tf-t+Tu+Ta,$$

and $$T2=(|Xa-Xw|/Vh)+(|Xb-Xw|/Vh)+\max(Tb,\ Tf)+Ta.$$

In these equations, Xa is a presupposed printing end position; Xb is a presupposed printing start position; Xw is a position outside the region where the printing medium exists; Vh is the printing head move speed; Tb is the time between a start of deceleration of the printing head and the completion of stopping of the printing head; Td is the time period required for the platen mechanism to release the pressing force; Tf is the time period required for the feed mechanism to feed the printing medium to the position corresponding to the next line to be printed; t is a possible time overlap between Td and Tf; Tu is the time period required for the platen mechanism to restore the pressing force; Ta is the time period between a start of acceleration of the printing head and a time at which the printable speed is reached; and max(a, b) is a function for selecting the larger of a and b.

FIG. 17 is a diagram showing an example of the head locus in the case where the above-described control method is used. When the printing head 6 is located on the printing medium 14, the platen bar is moved downward to enable line feed. When the printing head 6 is located outside the region corresponding to the printing medium 14, a line feed is made without moving the platen bar downward.

In the printer and the control method of the above-described embodiment, the speed of printing even on a printing medium having a hold or variation in thickness can be increased while maintaining the desired printing quality.

The present invention has been described with respect to the embodiment thereof. However, the present invention is not limited to the described embodiment and various modifications and changes of the embodiment may be made without departing from the scope of the invention.

For example, while a bankbook or the like has been mentioned as an example of the printing medium having a fold and variation in thickness, ordinary paper, carbon paper, etc., may also be used. Also, while an example of the head roller having a cylindrical shape has been described, the head roller may alternatively have a conical or spherical shape.

The arrangement which typifies the present invention disclosed has the advantages of enabling the printing apparatus to maintain high printing quality and increasing the printing speed of the printing apparatus.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A printer, comprising:

a printing head for performing printing while moving over a printing medium;

a gap roller capable of rolling along a direction of moving of said printing head;

a platen bar placed so as to face said printing head and said gap roller;

a feeding unit for moving the printing medium between said printing head and said platen bar;

a unit for calculating a first time period required for printing of the currently printed line and the next line to be printed in the case where the pressing force is released, the feeding unit feeds the printing medium, and the pressing force is then restored, and a second time period required for printing of the currently printed line and the next line to be printed in the case where the pressing force is not released;

a unit for making a determination as to whether the first time period is shorter than the second time period; and a controller for controlling a pressing force of said platen bar applied to said gap roller according to a printing end position of said printing head on the printing medium, wherein said controller releases the pressing force if, after the completion of printing of the currently printed line, said printing head is stopped at a position on the printing medium which is one of the printing end position with respect to the currently printed line and a print start position with respect to printing of the next line, and restores the pressing force after said feeding unit has fed the printing medium, said controller does not release the pressing force if, after the completion of the printing of the currently printed line, said printing head is stopped at a position outside the region where the printing medium exists, and said controller executes control corresponding to the shorter of the first and second time periods.

2. The printer according to claim 1, wherein said unit for calculating the first and second time periods includes:

a unit for obtaining a presupposed print end position with respect to the currently printed line; and a unit for obtaining a presupposed print start position with respect to the next line to be printed, wherein the first time period (T1) is calculated on the basis of an equation:

$$T1=(|Xa-Xb|/Vh)+\max(Tb,\ Td)+Tf-t+Tu+Ta,$$

(where Xa is the presupposed printing end position; Xb is the presupposed printing start position; Vh is the moving speed of said printing head; Tb is the time between a start of deceleration of the printing head and the completion of stopping of said printing head; Td is the time period required for said controller to release the pressing force; Tf is the time period required for said feeding unit to feed the printing medium to the position corresponding to the next line to be printed; t is a possible time overlap between Td and Tf; Tu is the time period required for said controller to restore the pressing force; Ta is the time period between a start of acceleration of said printing head and a time at which the printable speed is reached; and max(a, b) is a function for selecting the larger of a and b), and the second time period (T2) is calculated on the basis of an equation:

$$T2=(|Xa-Xb\ |/Vh)+(|Xb-Xw|/Vh)+\max(Tb,\ Tf)+Ta$$

(where Xw is the position outside the region where the printing medium exists, and other terms are the same as those in the above equation).

3. The printer according to claim 1, wherein said controller comprises:

a plurality of levers each having one end pinned upon a lower portion of said platen bar and rotatable about an axis of rotation perpendicular to a direction in which said platen bar is moved;

and a single parallel link extending parallel to said platen bar and pinned upon the other end of each of said lever, wherein as said parallel link moves in a direction corresponding to the direction of rotation of said lever, said platen bar is translated in a direction perpendicular to the direction of movement of said parallel link.

4. The printer according to claim 3, wherein said controller further comprises:

a first spring for rotating said lever in a first direction such as to move said platen bar upward; and a driving unit for applying a force to the other end of said lever or to said parallel link to make said lever rotate in a second direction opposite to the first direction.

5. The printer according to claim 4, wherein an elastic member is provided between the other end of said lever or said parallel link and said driving unit.

6. The printer according to claim 1, wherein said printing head is a wire dot printing head.

7. The printer according to claim 6, wherein said printing head has a sensor for detecting an edge of the printing medium.

8. The printer according to claim 1, wherein the printing medium is not uniform in thickness along the direction of moving of said printing head.

9. The printer according to claim 1, wherein said printing head is a bubble jet printing head.

10. The printer according to claim 1, wherein said printing head is an ink jet printing head.

11. The printer according to claim 1, wherein said printing head is a thermal transfer type of printing head.

12. The printer according to claim 1, wherein said printing head is a thermal sublimation type of printing head.

13. A method of controlling a printer having a printing head for performing printing while moving over a printing medium, a gap roller capable of rolling along the direction of moving of the printing head, a platen bar placed so as to face the printing head and the gap roller, a controller for controlling the pressing force of the platen bar applied to the gap roller according to a printing end position of the printing head on the printing medium, and a feeding unit for moving the printing medium between the printing head and the platen bar, comprising the steps of:

starting printing of a currently printed line;

calculating a first time period required for printing of the currently printed line and the next line to be printed in a case where after the completion of printing of the currently printed line the printing head is stopped at a position on the printing medium which is one of the printing end position with respect to the currently printed line and a print start position with respect to printing of the next line, the pressing force is released, the feeding unit feeds the printing medium, and the pressing force is then restored;

calculating a second time period required for printing of the currently printed line and the next line to be printed in a case where after the completion of the printing of the currently printed line the printing head is stopped at a position outside the region where the printing medium exists, and the feeding unit feeds the printing medium while the pressing force is not released; and making a determination as to whether the first time period is shorter than the second time period.

14. The method of controlling a printer according to claim 13, wherein if the result of the determination as to whether the first time period is shorter than the second time period is true, further include the steps of:

stopping the printing head at the printing end position with respect to the currently printed line and the print start position with respect to the next line to be printed, after the completion of the printing of the currently printed line;

releasing the pressing force;

feeding the printing medium for a line feed;

restoring the pressing force; and starting printing of the next line to be printed are executed, and wherein, if the result of the determination as to whether the first time period is shorter than the second time period is false, the includes steps of:

stopping the printing head at the position outside the region where the printing medium exists after the completion of the printing of the currently printed line;

feeding the printing medium for a line feed and while the pressing force is nor released; and starting printing of the next line to be printed are executed.

15. The method of controlling a printer according to claim 14, wherein the printing head has a sensor for detecting an edge of the printing medium, further comprising the steps of:

detecting two edges of the printing medium at the time of printing of the first line on the printing medium; and recording a position outside the region between the edges as the position outside the region where the printing medium exists.

16. The method of controlling a printer according to claim 15, wherein said steps of calculating the first and second time periods comprise the steps of:

obtaining a presupposed print end position with respect to the currently printed line; and obtaining a presupposed print start position with respect to the next line to be printed, wherein the first time period (T1) is calculated on the basis of an equation:

$$T1=(|Xa-Xb|/Vh)+\max(Tb,\ Td)+Tf-t+Tu+Ta,$$

(where Xa is the presupposed printing end position; Xb is the presupposed printing start position; Vh is the moving speed of said printing head; Tb is the time between a start of deceleration of the printing head and the completion of stopping of said printing head; Td is the time period required for said controller to release the pressing force; Tf is the time period required for said feeding unit to feed the printing medium to the position corresponding to the next line to be printed; t is a possible time overlap between Td and Tf; Tu is the time period required for said controller to restore the pressing force; Ta is the time period between a start of acceleration of said printing head and a time at which the printable speed is reached; and max(a, b) is a function for selecting the larger of a and b), and the second time period (T2) is calculated on the basis of an equation:

$$T2=(|Xa-Xw|/Vh)+(|Xb-Xw|/Vh)+\max(Tb,\ Tf)+Ta$$

(where Xw is the position outside the region where the printing medium exists, and other terms are the same as those in the above equation).

17. The method of controlling a printer according to claim 13, further comprising of the step of having a printing head that is a wire dot printing head.

18. The method of controlling a printer according to claim 13, further comprising the step of using the printing medium is not uniform in thickness along the direction of reciprocal moving of the printing head.

19. The method of controlling a printer according to claim 13, further comprising of the step of having a printing head that is a bubble jet printing head.

20. The method of controlling a printer according to claim 13, further comprising of the step of having a printing head that is an ink jet printing head.

21. The method of controlling a printer according to claim 13, further comprising of the step of having a printing head that is a thermal transfer type of printing head.

22. The method of controlling a printer according to claim 13, further comprising of the step of having a printing head that is a thermal sublimation type of printing head.

* * * * *

UNITED STATES PATENT AND TRADEMARK OFFICE

CERTIFICATE OF CORRECTION

PATENT NO. : 6,669,382 B2
DATED : December 30, 2003
INVENTOR(S) : Takenoshita et al.

It is certified that error appears in the above-identified patent and that said Letters Patent is hereby corrected as shown below:

Column 12,
Line 14, "T2 = ( |Xa - Xb| /Vh) + ( |Xb - Xw| /Vh) + max(Tb, Tf) + Ta" should be -- T2 = ( |Xa - Xw| /Vh) + ( |Xb - Xw| /Vh) + max(Tb, Tf) + Ta --.

Column 13,
Line 44, "nor" should be -- not --.

Signed and Sealed this

Seventeenth Day of February, 2004

JON W. DUDAS
*Acting Director of the United States Patent and Trademark Office*